United States Patent [19]

Grasshoff et al.

[11] 4,134,768

[45] Jan. 16, 1979

[54] PHOTOGRAPHIC USES OF POLYVINYL-PHENYLMERCAPTO-TETRAZOLES

[75] Inventors: J. Michael Grasshoff, Hudson; Jerome L. Reid, Wayland, both of Mass.

[73] Assignee: Polaroid Corporation, Cambridge, Mass.

[21] Appl. No.: 783,552

[22] Filed: Apr. 1, 1977

Related U.S. Application Data

[63] Continuation-in-part of Ser. No. 718,012, Aug. 26, 1976, abandoned.

[51] Int. Cl.[2] ..... G03C 1/76; G03C 1/40; G03C 7/00; G03C 1/48

[52] U.S. Cl. ..... 96/73; 96/3; 96/29 D; 96/74; 96/76 R; 96/77; 96/95; 96/96; 96/99; 96/100 R; 96/114

[58] Field of Search ..... 96/76 R, 77, 73, 74, 96/96, 95, 114, 100, 99; 260/79

[56] References Cited

U.S. PATENT DOCUMENTS

| | | | |
|---|---|---|---|
| 3,397,987 | 8/1968 | Luckey et al. | 96/109 |
| 3,721,555 | 3/1973 | Becker et al. | 96/77 |
| 3,748,129 | 7/1973 | Autges et al. | 96/77 |
| 3,787,209 | 1/1974 | Land | 96/77 |
| 3,819,379 | 6/1974 | Ohyama et al. | 96/114 |
| 3,936,401 | 2/1976 | Grasshoff et al. | 260/79 |

*Primary Examiner*—Richard L. Schilling
*Attorney, Agent, or Firm*—Esther A. H. Hopkins

[57] ABSTRACT

Polymeric derivatives of tetrazole-5-thiols are useful in conjunction with photosensitive silver halide elements as interlayers to provide interimage control, as dispersants for dye image-forming materials or as silver scavengers.

47 Claims, 3 Drawing Figures

PHOTOGRAPHIC USES OF POLYVINYL-PHENYLMERCAPTO-TETRAZOLES

This application is a continuation in part of application Ser. No. 718,012 filed Aug. 26, 1976 in the names of J. M. Grasshoff and J. L. Reid and now abandoned.

BACKGROUND OF THE INVENTION

As disclosed in U.S. Pat. No. 2,983,606, issued May 9, 1961, a photosensitive element with diffusion transfer utility, containing a dye developer, that is a dye which is a silver halide developing agent, and a silver halide emulsion, may be exposed to actinic radiation and wetted by a liquid processing composition, for example, by immersion, coating, spraying, flowing, etc., in the dark, and the exposed photosensitive element may be superposed prior to, during, or after wetting, on a sheetlike support element which may be utilized as an image-receiving element. In a preferred embodiment, the liquid processing composition is applied to the photosensitive element in a substantially uniform layer as the photosensitive element is brought into superposed relationship with the image-receiving layer. The liquid processing composition, positioned intermediate the photosensitive element and the image-receiving element, permeates the emulsion to initiate development of the latent image contained therein. The dye developer is immobilized or precipitated in exposed areas as a consequence of the development of the latent image. This immobilization is apparently, at least in part, due to a charge in the solubility characteristics of the dye developer upon oxidation and especially as regards its solubility in alkaline solutions. It may also be due in part to a tanning effect on the emulsion by oxidized developing agent, and in part to a localized exhaustion of alkali as a result of development. In undeveloped and partially developed areas of the emulsion, the dye developer is unreacted and diffusible and thus provides an imagewise distribution of unoxidized dye developer dissolved in the liquid processing composition, as a function of the point-to-point degree of exposure of the silver halide emulsion. At least part of this imagewise distribution of unoxidized dye developer is transferred, by imbibition, to a superposed image-receiving layer or element, said transfer substantially excluding oxidized dye developer. The image-receiving element receives a depthwise diffusion, from the developed emulsion, of unoxidized dye developer without appreciably disturbing the imagewise distribution thereof to provide the reversed or positive color image of the developed image. The image-receiving element may contain agents adapted to mordant or otherwise fix the diffused, unoxidized dye developer. If the color of the transferred dye developer is affected by changes in the pH of the image-receiving element, this pH may be adjusted in accordance with well-known techniques to provide a pH affording the desired color. The desired positive image is revealed by stripping the image-receiving layer from the photosensitive element at the end of a suitable imbibition period.

The dye developers, as noted above, are compounds which contain, in the same molecule, both the chromophoric system of a dye and a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

Multicolor images may be obtained by diffusion transfer processes using color image-forming components such as, for example, the previously mentioned dye developers, by several techniques. One such technique contemplates obtaining multicolor transfer images utilizing dye developers by employment of an integral multilayer photosensitive element, such as is disclosed in the aforementioned U.S. Pat. No. 2,983,606, and particularly with reference to FIG. 9 of the patent's drawing, wherein at least two selectively sensitized photosensitive strata, superposed on a single, dimensionally stable support are processed simultaneously and without separation, with a single, common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion layer, for example, in the form of particles, or it may be employed as a layer behind the appropriate silver halide emulsion strata. Ideally, each dye developer should develop only contiguous silver halide, to wit, the cyan dye developer should develop only the red-sensitive silver halide emulsion layer, the magenta dye developer should develop only the green-sensitive silver halide emulsion layer, and the yellow dye developer should develop only the blue-sensitive silver halide emulsion layer in a conventional three-color system. However, in practice, each dye developer has been found to develop to an undesirable extent each silver halide emulsion layer. The result of this effect is to produce color contamination and desaturation of colors in the transfer prints. Each set of silver halide emulsion and associated dye developer strata are disclosed to be optionally separated from other sets by suitable interlayers, for example, by a layer of gelatin or polyvinyl alcohol. In certain instances, it may be desirable to incorporate a yellow filter in front of the green-sensitive emulsion and such yellow filter may be incorporated in an interlayer or in the yellow dye layer. However, where desirable, a yellow filter may be employed. In such instances, a separate yellow filter may be omitted.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide emulsion. Specifically, the dye developer may, for example, be in a coating or layer behind the respective silver halide emulsion and such a layer of dye developer may be applied by use of a coating solution containing about 0.5 to 8%, by weight, of the respective dye developer distributed in a film-forming natural, or synthetic, polymer, for example, gelatin, polyvinyl alcohol, and the like, adapted to be permeated by the chosen diffusion transfer fluid processing composition.

An extensive compilation of specific dye developers particularly adapted for employment in photographic diffusion transfer processes is set forth in aforementioned U.S. Pat. No. 2,983,606 and in the various copending U.S. applications referred to in that patent, especially in the table of U.S. applications incorporated by reference into the patent as detailed in column 27. For examples of additional U.S. patents detailing specific dye developers for photographic transfer process use, mention may also be made of U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,135,605; 3,135,606; 3,135,734; 3,141,772; 3,142,565; and the like.

In addition to conventional techniques for the direct dispersion of a particulate solid material in a polymeric or colloidal matrix, such as ball-milling and the like techniques, the preparation of the dye developer dispersion may also be obtained by dissolving the dye in an appropriate solvent, or mixture of solvents, and the resultant solution distributed in the polymeric binder, with optional subsequent removal of the solvent, or solvents, employed, as, for example, by vaporization where the selected solvent, or solvents, possesses a sufficiently low boiling point or washing where the selected solvent, or solvents, possesses a sufficiently high differential solubility in the wash medium, for example, water, when measured against the solubility of the remaining composition components, and/or obtained by dissolving both the polymeric binder and dye in a common solvent.

For further detailed treatment of solvent distribution systems of the types referred to above, and for an extensive compilation of the conventional solvents traditionally employed in the art to effect distribution of photographic color-providing materials in polymeric binders, specifically for the formation of component layers of photographic film units, reference may be made to U.S. Pat. Nos. 2,269,158; 2,322,027; 2,304,939; 2,304,940; 2,801,171 and the like.

U.S. Pat. No. 3,362,819 discloses image-receiving elements, particularly adapted for employment in the preceding diffusion transfer processes, which comprise a support layer possessing on one surface thereof, in sequence, a polymeric acid layer, preferably an inert timing or spacer layer, and an image-receiving layer adapted to provide a visible image upon transfer to said layer of diffusible dye image-forming substance.

As set forth in the last-mentioned patent the polymeric acid layer comprises polymers which contain acid groups, such as carboxylic acid and sulfonic acid groups, which are capable of forming salts with alkali metals, such as sodium, potassium, etc., or with organic bases, particularly quaternary ammonium bases, such as tetramethyl ammonium hydroxide, or potentially acid-yielding groups, such as anhydrides or lactones, or other groups which are capable of reacting with bases to capture and retain them. The acid-reacting group, is, of course, nondiffusible from the acid polymer layer. In the preferred embodiments disclosed, the acid polymer contains free carboxyl groups and the transfer processing composition employed contains a large concentration of sodium and/or potassium ions. The acid polymers stated to be most useful are characterized by containing free carboxyl groups, being insoluble in water in the free acid form, and by forming water-soluble sodium and/or potassium salts. One may also employ polymers containing carboxylic acid anhydride groups, at least some of which preferably have been converted to free carboxyl groups prior to imbibition. While the most readily available polymeric acids are derivatives of cellulose or of vinyl polymers, polymeric acids from other classes of polymers may be used. As examples of specific polymeric acids set forth in the application, mention may be made of dibasic acid half-ester derivatives of cellulose which derivatives contain free carboxyl groups, e.g., cellulose acetate hydrogen phthalate, cellulose acetate hydrogen glutarate, cellulose acetate hydrogen succinate, ethyl cellulose hydrogen succinate, ethyl cellulose acetate hydrogen succinate, cellulose acetate hydrogen succinate hydrogen phthalate; ether and ester derivatives of cellulose modified with sulfoanhydrides, e.g., with orthosulfobenzoic anhydride; polystyrene sulfonic acid; carboxylmethyl cellulose; polyvinyl hydrogen phthalate; polyvinyl acetate hydrogen phthalate; polyacrylic acid; acetals of polyvinyl alcohol with carboxy substituted aldehydes, e.g., o-, m-, or p-benzaldehyde carboxylic acid; partial esters of ethylene/maleic anhydride copolymers; partial esters of methylvinyl ether/maleic anhydride copolymers; etc.

The acid polymer layer is disclosed to contain at least sufficient acid groups to effect a reduction in the pH of the image layer from a pH of about 12 to 14 to a pH of at least 11 or lower at the end of the imbibition period, and preferably to a pH of about 5 to 8 within a short time after imbibition. As previously noted, the pH of the processing composition preferably is of the order of at least 12 to 14.

It is, of course, necessary that the action of the polymeric acid be so controlled as not be interfere with either development of the negative or image transfer of unoxidized dye developers. For this reason, the pH of the image layer is kept at a level of pH 12 to 14 until the positive dye image has been formed after which the pH is reduced very rapidly to at least about pH 11 and preferably about pH 9 to 10, before the positive transfer image is separated and exposed to air. Unoxidized dye developers containing hydroquinonyl developing radicals diffuse from the negative to the positive as the sodium or other alkali salt. The diffusion rate of such dye image-forming components thus is at least partly a function of the alkali concentration, and it is necessary that the pH of the image layer remain on the order of 12 to 14 until transfer of the necessary quantity of dye has been accomplished. The subsequent pH reduction, in addition to its desirable effect upon image light stability, serves a highly valuable photographic function by substantially terminating further dye transfer. The processing technique thus effectively minimizes changes in color balance as a result of longer imbibition times in multicolor transfer processes using multilayer negatives.

In order to prevent premature pH reduction during transfer processing, as evidenced, for example, by an undesired reduction in positive image density, the acid groups are disclosed to be so distributed in the acid polymer layer that the rate of their availability to the alkali is controllable, e.g., as a function of the rate of swelling of the polymer layer which rate in turn has a direct relationship to the diffusion rate of the alkali ions. The desired distribution of the acid groups in the acid polymer layer may be effected by mixing the acid polymer with a polymer free of acid groups, or lower in concentration of acid groups, and compatible therewith, or by using only the acid polymer but selecting one having a relatively lower proportion of acid groups.

It is also disclosed that the layer containing the polymeric acid may contain a water insoluble polymer, such as, for example, a cellulose ester, which acts to control or modulate the rate at which the alkali salt of the polymer acid is formed. As examples of cellulose esters contemplated for use, mention is made of cellulose acetate, cellulose acetate butyrate, etc. The particular polymers and combination of polymers employed in any given embodiment are, of course, selected so as to have adequate wet and dry strength and when necessary or desirable, suitable subcoats may be employed to help the various polymeric layers adhere to each other during storage and use.

The inert spacer layer of the aforementioned patent, for example, an inert spacer layer comprising polyvinyl alcohol or gelatin, acts to "time" control the pH reduction by the polymeric acid layer. This timing is disclosed to be a function of the rate at which the alkali diffuses through the inert spacer layer. It was stated to have been found that the pH does not drop until the alkali has passed through the spacer layer, i.e., the pH is not reduced to any significant extent by the mere diffusion into the interlayer, but the pH drops quite rapidly once the alkali diffuses through the spacer layer.

As examples of materials, for use as the image-receiving layer, mention may be made of solution dyeable polymers such as nylons as, for example, N-methoxymethyl polyhexamethylene adipamide; partially hydrolyzed polyvinyl acetate; polyvinyl alcohol with or without plasticizers; cellulose acetate with filler as, for example, one-half cellulose acetate and one-half oleic acid; gelatin; and other materials of a similar nature. Preferred materials comprise polyvinyl alcohol or gelatin containing a dye mordant such as poly-4-vinylpyridine, as disclosed in U.S. Pat. No. 3,148,061, issued Sept. 8, 1964.

As disclosed in the previously cited patents, the liquid processing composition referred to for effecting multicolor diffusion transfer processes comprises at least an aqueous solution of an alkaline material, for example, sodium hydroxide, potassium hydroxide, and the like, and preferably possessing a pH in excess of 12. Where this liquid processing composition is to be applied to the photosensitive emulsion stratum by being spread thereon, preferably in a relatively thin and uniform layer intermediate that stratum and a superposed image-receiving layer, it is disclosed to include a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time are also disclosed to be capable of utilization. As stated, the film-forming material is preferably contained in the processing composition in such suitable quantities as to impart to the composition a viscosity in excess of 100 cps. at a temperature of approximately 24° C. and preferably in the order of 100,000 cps. to 200,000 cps. at that temperature.

It is a primary object of the present invention to provide novel photographic diffusion transfer color processes and novel photosensitive elements particularly adapted for employment in such processes.

A further object of the present invention is to provide products for use in photographic diffusion transfer color processes which include a photosensitive element which comprises a plurality of essential layers superposed upon a common support including selectively sensitized photosensitive layers each having associated therewith a dye image-forming material which is soluble and diffusible in alkali such photosensitive layers having associated therewith certain polymeric derivatives of tetrazole-5-thiols as described more fully below.

Another object of the present invention is to provide a product for use in a photographic diffusion transfer color process comprising a photosensitive element, as described above, in combination with a photographic diffusion transfer image-receiving composite structure comprising a plurality of essential layers including a solution-dyeable polymeric layer.

Further, it is an object of the present invention to provide a product for use in a diffusion transfer photographic color process which product comprises a photosensitive element and transfer image-receptive composite structure each as identified above and a fluid photographic processing composition.

Other objects of the invention will in part be obvious and will in part appear hereinafter.

The invention accordingly comprises the product possessing the features, properties and the relation of components, and the process involving the several steps and the relation and order of one or more of such steps with respect to each of the others which are exemplified in the following detailed disclosure, and the scope of the application of which will be indicated in the claims.

For a fuller understanding of the nature and objects of the invention, reference should be had to the following detailed description taken in connection with the accompanying drawing, wherein:

FIG. 1 is an enlarged diagrammatic fragmentary section view illustrating one aspect of this invention, FIG. 2 is a similar view illustrating another aspect of the invention, and FIG. 3 illustrates still a third aspect of the invention.

SUMMARY OF THE INVENTION

Certain polymeric derivatives of tetrazole-5-thiols and their metal and ammonium salts have been found to be useful in photosensitive elements. Said compounds are useful beneath a silver halide emulsion layer, for example, as a dispersant binder for a dye image-forming material; in a silver halide emulsion layer, for example, as a scavenger for soluble silver; between silver halide emulsion layers for interimage control; or over silver halide emulsion layers to prevent darkening of an image-receiving layer after processing due to migration and subsequent deposition of reduced silver in such image-receiving layer.

The polymeric derivatives of tetrazole-5-thiols employed in the present invention are compounds of the following formula:

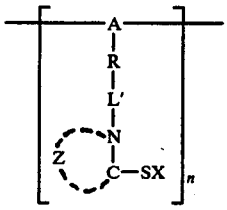

wherein A is an ethylenically unsaturated group which has been polymerized, R is a resonance stabilized group, L' is an optional linking group, X is alkali metal, primary, secondary, tertiary or quaternary ammonium, Z represents the atoms and bonds necessary to complete a tetrazole ring and n is an integer of at least 100.

For example, among the specific compounds included within the scope of this invention are the following thiols, their potassium and other alkali metal salts, their ammonium and primary, secondary, tertiarv and quaternary ammonium salts such as, for example, their tetramethyl ammonium salts.

poly[1-(p-vinylphenyl) 1,2,3,4-tetrazole-5-thiol],

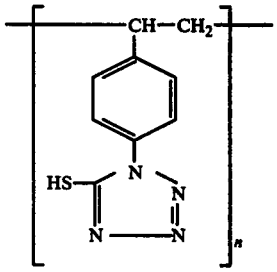

poly[1-(p-vinylbenzyl)-1,2,3,4-tetrazole-5-thiol],

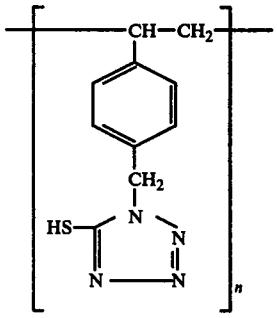

poly[1-(m-acrylamido-phenyl)-1,2,3,4-tetrazole-5-thiol],

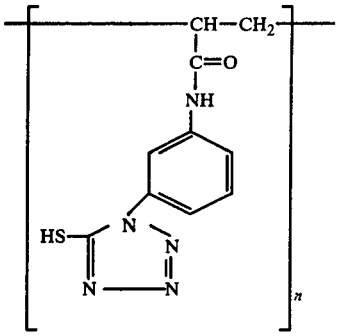

poly[1-(m-(2-acrylamido-2-methyl)-propionamido-phenyl)-1,2,3,4-tetrazole-5-thiol],

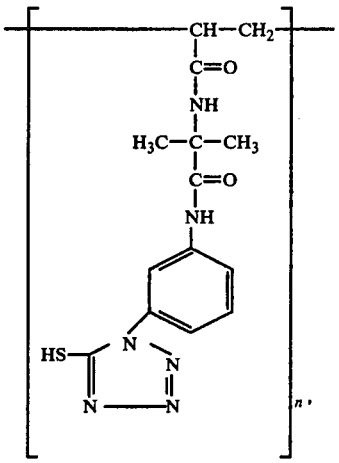

1-(p-formylphenyl)-tetrazole-5-thiol polyvinyl acetal

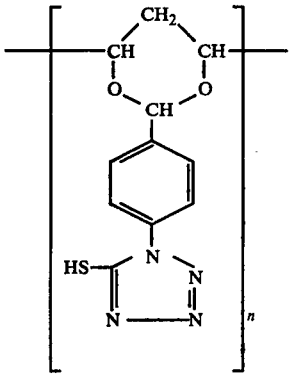

These compounds may be prepared by the methods detailed in U.S. Pat. No. 3,936,401.

This association with silver halide emulsions may be beneath, between or over said emulsions, for it has been discovered that the aforementioned polymeric tetrazole-5-thiol derivatives may be used as sole dispersants for the dye image-producing materials located next below the silver halide emulsion layer in said photosensitive systems; maybe used as silver scavengers between the silver halide emulsion layers as disclosed in copending application Ser. No. 574,296 filed May 5, 1975 in the names of R. F. Cieciuch, F. Meneghini, R.

Luhowy and H. G. Rogers, and now U.S. Pat. No. 4,060,417; or used as interlayers in said photosensitive systems for interimage control or as direct replacements for the types of latices disclosed in U.S. Pat. No. 3,421,892, allowing the manufacture of said systems without the use of the water-insoluble polymeric systems disclosed therein to form the interlayers; or may be used between silver halide emulsion layers as dispersants for the dye image-forming materials embodying the concepts of U.S. Pat. No. 3,748,129 issued July 23, 1973 to J. A. Avtges, J. L. Reid, H. N. Schlein and L. D. Taylor wherein the use of separate barrier layers is avoided by the combination of the barrier function into the dye image-forming layer by the expedient of dispersing the dye image-forming material with the barrier forming material; may be used to prevent darkening of a superposed image-receiving element by transferred silver complex by being placed over the silver halide emulsion layer to control the migration of silver ions while allowing dye image-forming molecules to pass therethrough. According to the present invention these compounds may be employed in non-photosensitive layers of photosensitive elements and particularly photosensitive elements useful in diffusion transfer photography.

As disclosed in U.S. Pat. No. 3,438,775, a known method of preparing a dye image-providing material in the form of a dye developer paste for coating is to form an aqueous slurry comprising about 7% dye, by weight, and 2 to 15%, by weight of dye, of a surfactant comprising, for example, the sodium salt of a condensed mononaphthalene sulfonic acid, at a pH of about 7 to 8, sonifying the slurry for 15+ minutes and dispersing in a binder, for example, gelatin. The polymeric tetrazole-5-thiol derivatives of this present invention have been found to be excellent sole dispersants and binders for the dye image-providing materials of the aforementioned photosensitive systems, performing both the dispersing function of the derivatized sulfonic acid and the binding function of the gelatin.

Interlayers between each set of silver halide layers and associated dye image-providing materials, may be manufactured as disclosed, for example, in U.S. Pat. No. 3,756,816 wherein the coating dispersion is disclosed to be a latex/permeator composition containing the appropriate ratios of ingredients formed by the addition of an aqueous solution of a permeator to a latex emulsion. "Permeator" is used herein as defined in the aforementioned patent as a material which provides predetermined image-forming dye permeation characteristics to a coalesced latex, the latex comprising a synthetic polymer. It will be appreciated that coating solutions comprising admixtures of aqueous solutions and latex emulsions carry with them the inherent instability of mutually suspended nonmiscible components, and that "pot life" — the range of time in which said coating solutions may be used as coating solutions without further treatment — is a function of the onset of phase separation. A solution to this problem, made possible by the use of the polymeric tetrazole-5-thiol derivatives of this invention, is the preparation of satisfactory negative interlayers from materials which are water soluble, providing stable solutions for handling and coating. A satisfactory negative interlayer must, of course, act to provide a barrier with respect to retardation of the positional displacement of the dye image-providing material prior to establishment of substantial imagewise emulsion control of the associated dye image-providing material's diffusion, and must be capable of providing an optically clear film. Such interlayers are formed from the polymeric tetrazole-5-thiol derivatives of this invention.

It has previously been disclosed, in aforementioned U.S. Pat. No. 3,748,129 that the dispersion of one or more silver halide emulsion-associated dye image-forming material components of an integral multilayer photosensitive element in a layer comprising a synthetic polymer permeable to processing composition (hydroxyl ion) and solubilized dye material at a rate which insures substantial development of each dye associated silver halide emulsion layer prior to contact of such layer with substantial amounts of solubilized unassociated dye material results in reduction of interimage effects due to back migration and a concomitant increase in ultimate color purity in the transferred image. It has been found that use of the polymeric derivatives of the tetrazole-5-thiols and their salts of this invention as dispersants for the aforesaid dye image-forming material results in good interimage control and can provide such control with an acceptable maximum density. For example, dispersal of a magenta dye developer in approximately 40 mg/ft$^2$ of poly[1-(p-vinylphenyl)-1,2,3,4-tetrazole-5-thiol] potassium salt, under a green sensitive silver iodobromide emulsion but over a red-sensitive silver iodobromide emulsion which is itself superposed on a cyan developer results in good interimage control with satisfactory maximum density of red and green in the processed receiving layer.

A silver halide solvent, such as, sodium thiosulfate can be included in a dye developer diffusion transfer color system designed to have the photosensitive element remain in superposed position relative to the image-receiving element after processing to improve the sensitometry of the process. Such inclusion, however, may result in the transfer of unreduced silver complex to the image-receiving element even though the image-receiving layer is free of any silver precipitating agent. Subsequent photolysis of such transferred silver complex is effective to reduce the complex to a colored species resulting in changes in the highlights or whites of the color image. Overcoating the photosensitive element of the diffusion transfer system with one of the polymeric derivatives of a tetrazole-5-thiol as defined in this invention leads to a reduction in the quantity of silver complex transferred.

As disclosed in before mentioned copending application Ser. No. 574,296 materials which form stable, non-diffusible complexes with silver ion and/or soluble silver complexes are useful in a silver scavenger layer employed between adjacent silver halide strata to enhance color separation in multicolor photographic images prepared by processes which utilize the imagewise distribution of silver ions and/or soluble silver complex made available during development to liberate a corresponding imagewise distribution of dye or dye intermediate from a color-providing compound.

DESCRIPTION OF THE FIGURES

The use of the polymeric tetrazole-5-thiols of this invention as a dispersant for the dye image-forming materials is illustrated in FIG. 1 where is shown a photosensitive element 18 which comprises: a support 10; a layer 11 comprising a dispersion of cyan dye image-forming material in a polymeric tetrazole-5-thiol derivative according to this invention; a layer 12 comprising a red sensitive silver halide emulsion; a layer 13 comprising a dispersion of magenta dye image-forming material in a polymeric tetrazole-5-thiol derivative according to this invention; a layer 14 comprising a green sensitive silver halide emulsion; a layer 15 comprising a dispersion of yellow dye image-forming material in a polymeric tetrazole-5-thiol derivative according to this invention; a layer 16 comprising a blue-sensitive silver halide emulsion; and 17 a protective overcoat layer.

As detailed in illustrative FIG. 2, a photosensitive element of the instant invention 50 comprises: a support 40; a layer 41 containing a cyan dye developer; a layer 42 comprising a red-sensitive silver halide emulsion; an interlayer 43 comprising a polymeric tetrazole-5-thiol derivative detailed above; a layer 44 containing a magenta dye developer; a layer 45 comprising a green-sensitive halide emulsion; an interlayer 46 comprising a polymeric tetrazole-5-thiol derivative detailed above; a layer 47 containing a yellow dye developer; a layer 48 comprising a blue-sensitive silver halide emulsion; and a protective overcoat layer 49.

Figure 1:
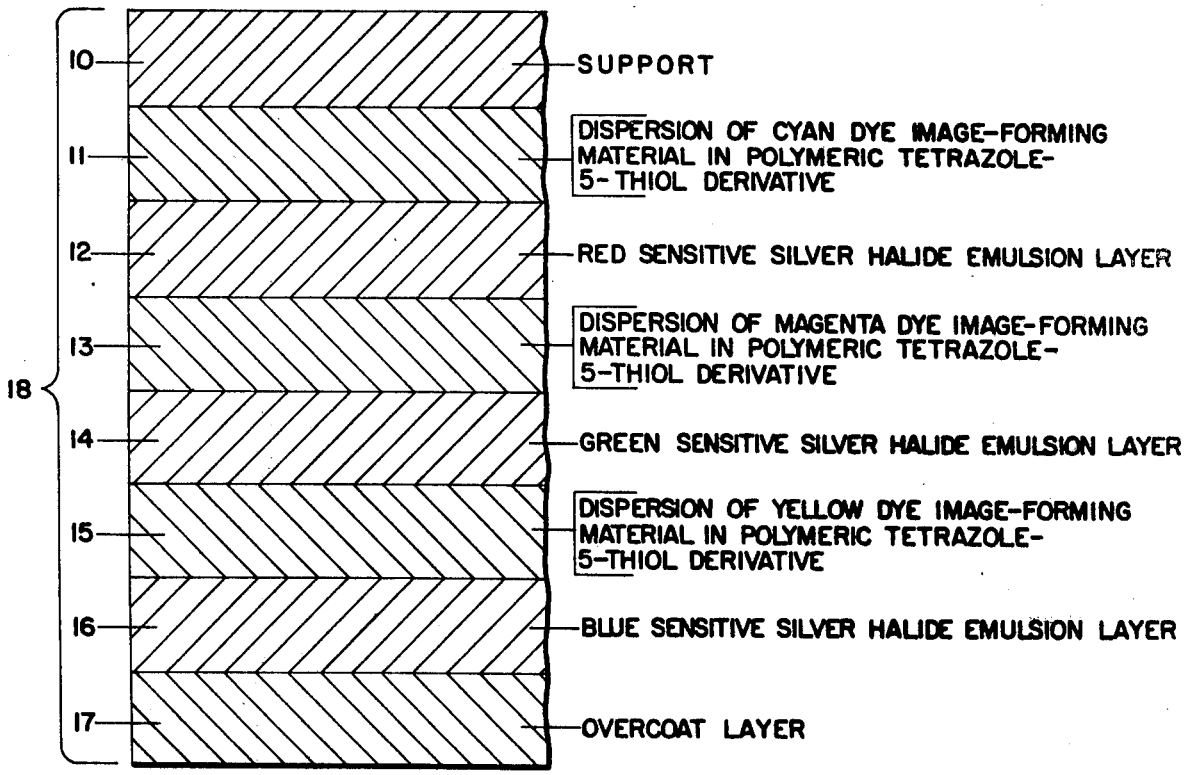
Figure 2:
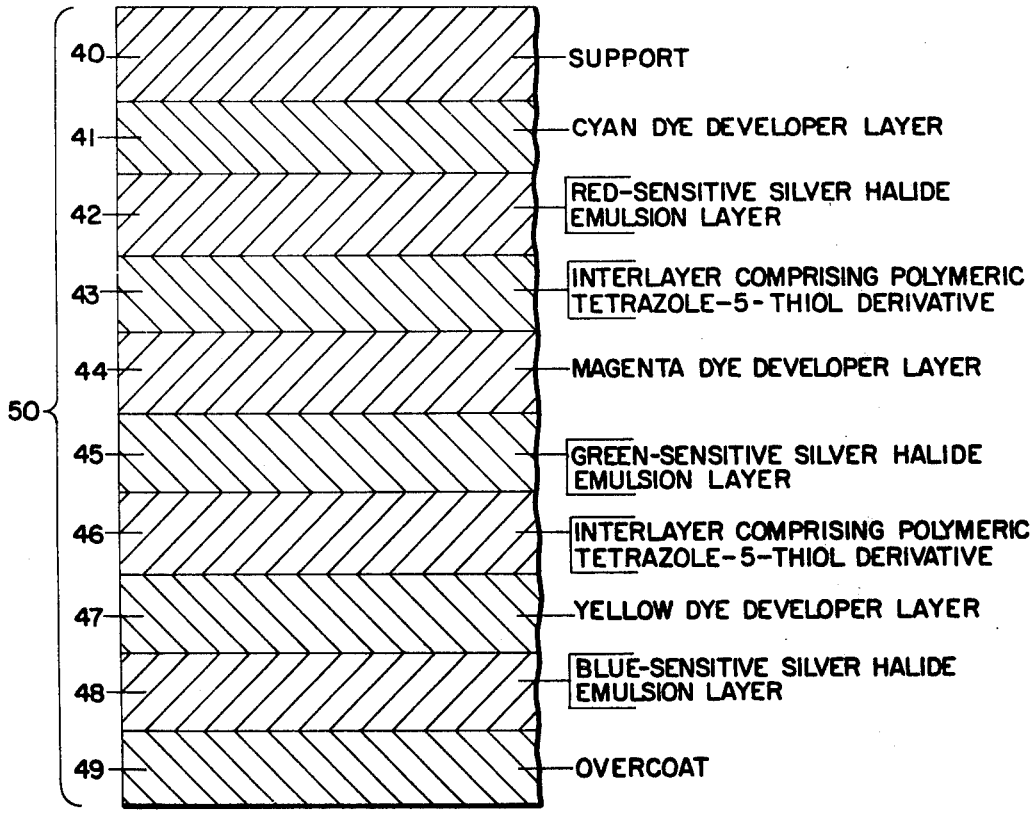
Figure 3:
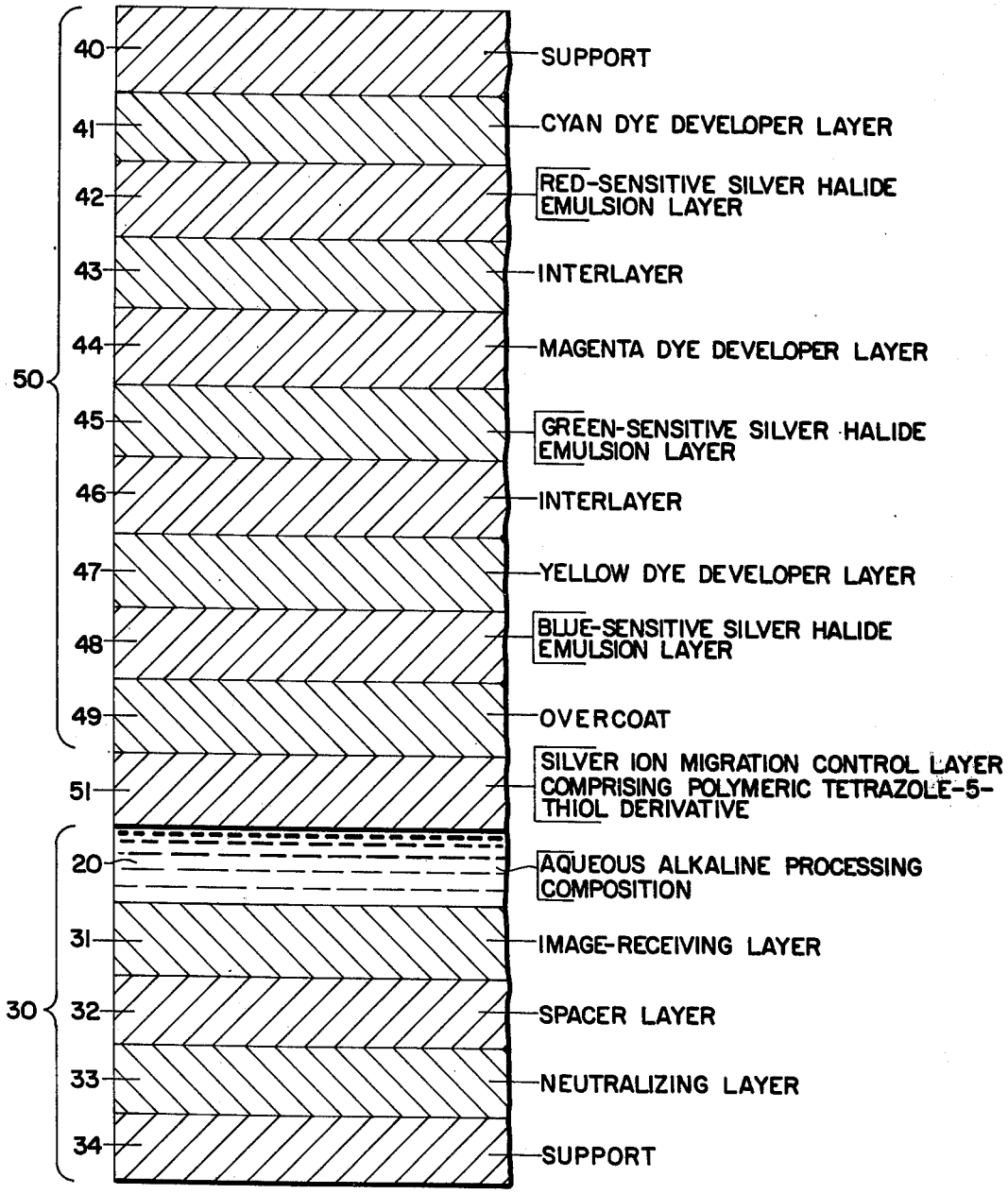

Another embodiment of the present invention is illustrated in FIG. 3 wherein is shown a photosensitive element 60 comprising in sequence on support 40, layers 41–49 as in FIG. 2 but on top of layer 49, the overcoat layer there is coated layer 51, a silver ion migration control layer comprising the polymeric tetrazole-5-thiol derivatives of this invention. This multilayer photosensitive element is shown in processing relationship with an image-receiving element 30 and a layer of processing composition distributed intermediate elements 50 and 30. Image-receiving element 30 comprises in sequence a transparent support 34, a neutralizing layer 33, a spacer layer 32 and an image-receiving layer 31.

The present invention will be illustrated with the following examples which set out the use of the polymeric derivatives of the tetrazole-5-thiols, as dispersants for dye developers, for interimage control and as a scavenger for silver.

EXAMPLE I

A control photosensitive element, PE-Cl was prepared by coating in succession on a 4 mil polyester clear film base, the following layers:

| Layer | Component(s) | | Coverage (mgs/ft$^2$) |
|---|---|---|---|
| (1) | a. | cyan dye developer | 70 |
| | b. | Gelatin | 100 |
| (2) | a. | red-sensitive gelatino silver iodobromide emulsion | 140 |
| | b. | gelatin | 70 |
| (3) | a. | BDSM* | 100 |
| | b. | polyacrylamide | 5 |
| | c. | succinaldehyde | 10 |
| (4) | a. | magenta dye developer | 65 |
| | b. | gelatin | 60 |
| (5) | a. | green-sensitive gelatino silver iodobromide emulsion | 80 |
| | b. | gelatin | 40 |
| (6) | a. | BDSM* | 100 |
| | b. | polyacrylamide | 5 |
| | c. | succinaldehyde | 5 |
| (7) | a. | yellow dye developer | 85 |
| | b. | gelatin | 50 |
| (8) | a. | blue-sensitive gelatino silver iodobromide emulsion | 120 |
| | b. | gelatin | 60 |
| (9) | a. | 4' methylphenyl hydroquinone | 15 |
| | b. | gelatin | 30 |

where BDSM* is 60-30-4-6 copolymer of butylacrylate, diacetone acrylamide, styrene and methacrylic acid, the cyan dye developer is:

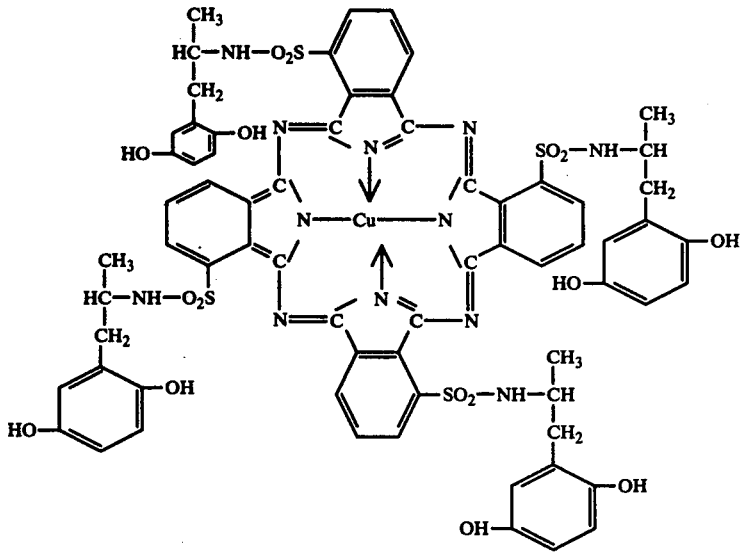

the magenta dye developer is:

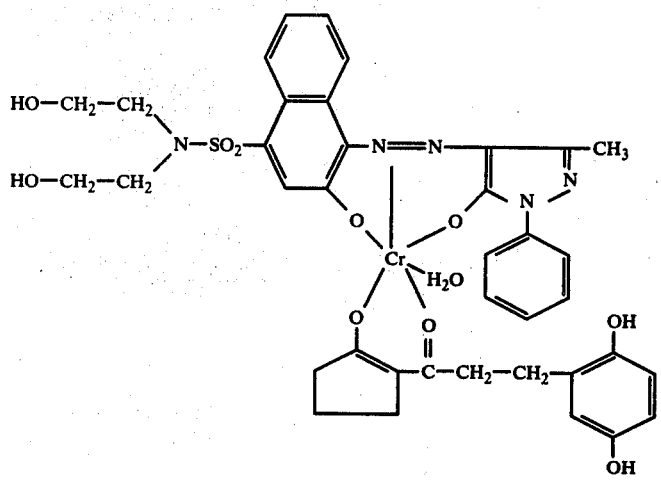

and the yellow dye developer is:

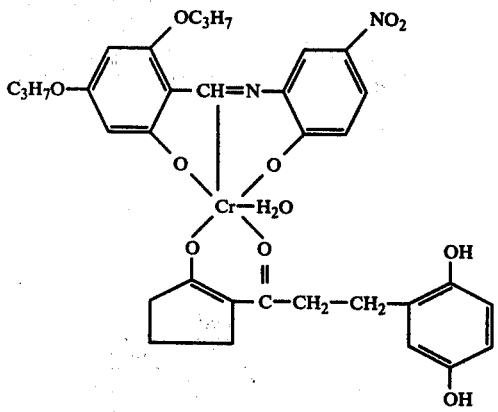

A test photosensitive element PE-T1 was prepared by coating in succession on a 4 mil polyester clear film base the following layers:

| Layer | Component(s) | Coverage (mgs/ft$^2$) |
|---|---|---|
| (1) | a. cyan dye developer | 70 |
| | b. gelatin | 100 |
| (2) | a. red-sensitive gelatino silver iodobromide emulsion | 140 |
| | b. gelatin | 70 |
| (3) | a. magenta dye developer | 65 |
| | b. PVPTT | 20 |
| | c. succinaldehyde | 5 |
| (4) | a. green-sensitive gelatino silver iodobromide emulsion | 80 |

-continued

| Layer | Component(s) | Coverage (mgs/ft$^2$) |
|---|---|---|
| | b. gelatin | 40 |
| (5) | a. BDSM | 100 |
| | b. polyacrylamide | 5 |
| | c. succinaldehyde | 5 |
| (6) | a. yellow dye developer | 85 |
| | b. gelatin | 50 |
| (7) | a. blue-sensitive gelatino silver iodobromide emulsion | 120 |
| | b. gelatin | 60 |
| (8) | a. 4' methylphenyl hydroquinone | 15 |
| | b. gelatin | 30 |

where PVPTT is the potassium salt of poly[1-(p-vinylphenyl)-1,2,3,4-tetrazole-5-thiol]. BDSM is as noted in the control and the cyan, magenta and yellow dye developers are as designated in the control.

A transparent 4 mil polyethylene terephthalate film base was coated, in succession, with the following layers to form an image-receiving component:

1. as a polymeric acid layer, the partial butyl ester of polyethylene/maleic anhydride copolymer at a coverage of about 2,500 mgs./ft.$^2$;

2. a timing layer containing about a 93:7 ratio of a 60-30-4-6 copolymer of butylacrylate, diacetone acrylamide, styrene and methacrylic acid and polyvinyl alcohol at a coverage about 500 mgs./ft.$^2$;

3. a polymeric image-receiving layer containing a 2:1 mixture, by weight, a polyvinyl alcohol and poly-4-vinylpyridine, at a coverage of about 300 mgs./ft.$^2$ The photosensitive elements were then exposed and processed in the dark by spreading an aqueous liquid processing composition comprising:

| | |
|---|---|
| Potassium hydroxide (85%) | 4.59 g. |
| N-benzyl-α-picolinium bromide (50% solution in water) | 1.25 g. |
| N-phenethyl-α-picolinium bromide | 0.72 g. |
| Sodium carboxymethyl cellulose (Hercules Type 7H4F providing a viscosity of 3,000 cps. at 1% in water at 25° C.) | 1.07 g. |
| Titanium dioxide | 41.8 g. |
| 6-methyl uracil | 0.29 g. |
| bis-(β-aminoethyl)-sulfide | 0.02 g. |
| Lithium nitrate | 0.1 g. |
| Benzotriazole | 0.56 g. |
| 6-methyl-5-bromo-4-azabenzimidazole | 0.03 g. |
| Colloidal silica aqueous dispersion (30% $SiO_2$) | 1.82 g. |
| N-2-hydroxyethyl-N,N',N'-tris- | |

-continued

| | |
|---|---|
| carboxymethyl-ethylene diamine | 0.83 g. |
| Lithium hydroxide | 0.2 g. |
| 6-benzylamino-purine | 0.39 g. |
| Polethylene glycol (molecular weight 6,000) | 0.54 g. |
| | 2.70 g. |

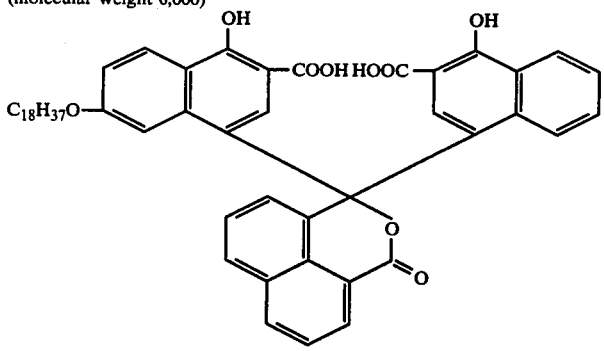

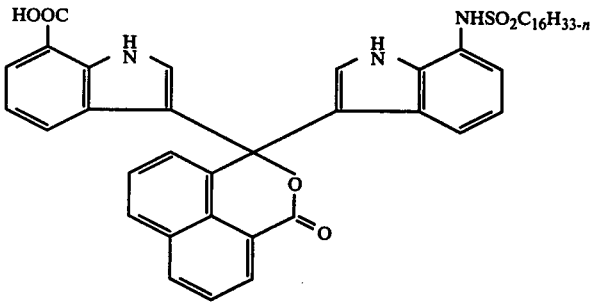

0.6 g.

Water to make 100 g.

between an image-receiving element and an exposed photo-sensitive element as they were brought into superposed relationship. Immediately the superposed elements were placed in a light tight box.

After a dark time of ten minutes, the superposed elements were viewed in room light. It was found that the interimage control in the sample was good. The red, green and blue reflection dye densities of both the control and test elements, as measured in a Macbeth densitometer were:

| | Red | Green | Blue |
|---|---|---|---|
| control | 2.14 | 1.26 | 1.54 |
| sample | 0.64 | 1.06 | 1.60 |

EXAMPLE 2

A photosensitive element, PE-2a, was prepared by coating in succession on a 4 mil polyester clear film base, the following layers:

| Layer | Component(s) | Coverage (mgs/ft$^2$) |
|---|---|---|
| (1) | a. cyan dye developer | 70 |
| | b. gelatin | 100 |
| (2) | a. red-sensitive gelatino silver iodobromide emulsion | 140 |
| | b. gelatin | 70 |
| (3) | a. magenta dye developer | 65 |
| | b. PVPTT | 40 |
| | c. succinaldehyde | 5 |
| (4) | a. green-sensitive gelatino silver iodobromide emulsion | 80 |
| | b. gelatin | 40 |
| (5) | a. BDSM | 100 |
| | b. polyacrylamide | 5 |
| | c. succinaldehyde | 5 |

-continued

| Layer | Component(s) | Coverage (mgs/ft$^2$) |
|---|---|---|
| (6) | a. yellow dye developer | 85 |
| | b. gelatin | 50 |
| (7) | a. blue-sensitive gelatino silver iodobromide emulsion | 120 |
| | b. gelatin | 60 |
| (8) | a. 4' methylphenyl hydroquinone | 15 |
| | b. gelatin | 30 |

where BDSM is 60-30-4-6 copolymer of butylacrylate, diacetone acrylamide, styrene and methacrylic acid, and the cyan, magenta, and yellow dye developers are as in Example 1.

A further photosensitive element, PE-2b, was prepared as above with the addition of 5 mg. of nickel nitrate to layer (2). These photosensitive elements were exposed, processed with the aqueous liquid processing composition of Example 1 and brought into superposed relationship with an image-receiving component as detailed in Example 1. After a dark processing time of ten minutes, the superposed elements were viewed in room light. It was found that good inter-image control was obtained in PE-2a which maximum density was satisfactory in both red and green. The results in PE-2b showed that interimage control can be retained with acceptable density maxima. Evidently what is occurring is that the divalent metal, upon diffusion into the interlayer is "loosening" the interlayer, that is, increasing the permeability of the interlayer to the diffusing dye image-forming material.

The red, green and blue reflection dye densities of both the control and test elements, as measured in a Macbeth densitometer were:

| | Red | Green | Blue |
|---|---|---|---|
| control | 0.40 | 1.59 | 2.00 |
| with nickel | 2.09 | 1.96 | 2.04 |

This combination use of multivalent metal salts with the polymeric derivatives of tetrazole-5-thiols is claimed in the copending U.S. Patent Application of Lloyd D. Taylor, Ser. No. 718,043 filed Aug. 26, 1976.

EXAMPLE 3

A photosensitive element using as the color-providing compounds to release a cyan dye and a yellow dye cyan

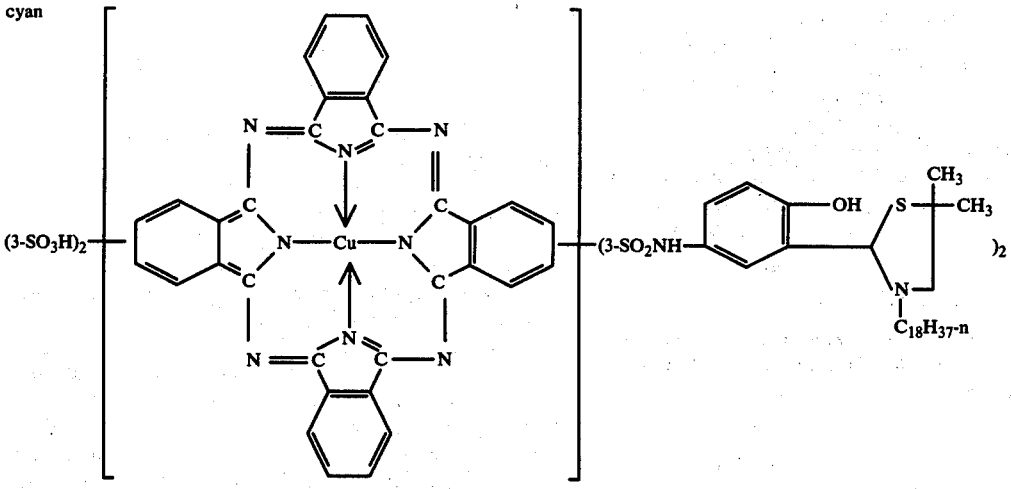

and yellow

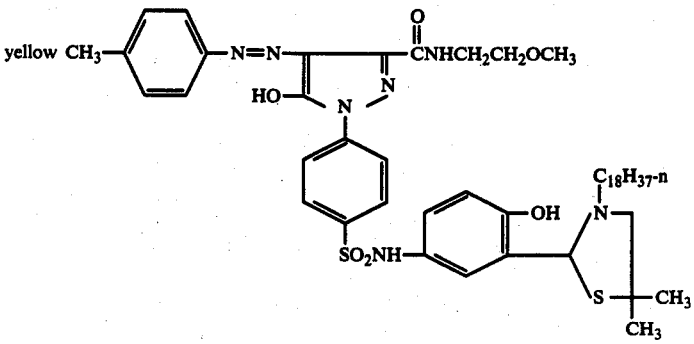

was prepared by coating a transparent polyethylene terephthalate film base with the following layers:

1. a layer of cyan color-providing compound dispersed in gelatin and coated at a coverage of about 60 mgs/ft.$^2$ of cyan color-providing compound and about 60 mgs/ft.$^2$ of gelatin;

2. a red-sensitive gelatino silver iodobromide emulsion coated at a coverage of about 35 mgs/ft.$^2$ of silver and about 60 mgs/ft.$^2$ of gelatin;

3. a layer of the potassium salt of poly [1-(p-vinylphenyl)-1H-5-mercaptotetrazole] coated at a coverage of about 100 mgs/ft.$^2$;

4. a layer of yellow color-providing compound and Padding Yellow GL (a benzidine yellow pigment employed as a yellow filter) dispersed in gelatin and coated at a coverage of about 40 mgs./ft.$^2$ of yellow color-providing compound, 50 mgs/ft.$^2$ of Padding Yellow GL and about 90 mgs./ft.$^2$ of gelatin;

5. a blue-sensitive gelatino silver iodobromide emulsion coated at a coverage of about 30 mgs/ft.$^2$ of silver and about 52 mgs/ft.$^2$ of gelatin; and 6. a layer of gelatin coated at a coverage of about 30 mgs/ft.$^2$.

A transparent polyethylene terephthalate film base was coated, in succession, with the following layers to form an image-receiving element:

1. a layer of the partial butyl ester of polyethylene/-maleic anhydride copolymer coated at a coverage of about 2500 mgs/ft.$^2$;

2. a layer containing a mixture (40:1 ratio) of a 60-30-4-6 copolymer of butylacrylate, diacetone acrylamide, styrene and methacrylic acid and polyacrylamide at a coverage of about 500 mgs./ft.$^2$; and 3. a polymeric image-receiving layer containing a 2:1 mixture, by weight, of polyvinyl alcohol and poly-4-vinylpyridine, at a coverage of about 300 mgs/ft.$^2$ and containing a silver halide solvent precursor of the formula

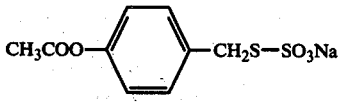

at a coverage of about 50 mgs/ft.$^2$.

The photosensitive element was exposed to red and blue light and processed, in the dark, in superposed relationship with the image-receiving element by spreading an aqueous alkaline processing composition in a layer approximately 0.0024 inch thick between the superposed elements. The processing composition employed comprised:

| | |
|---|---|
| Water | 100.0 cc. |
| Sodium hydroxide | 5.0 g. |
| Sodium carboxymethyl cellulose | 3.4 g. |
| Chlorohydroquinone | 1.3 g. |
| Phenidone | 0.7 g. |
| Sodium sulfite | 2.0 g. |
| Titanium dioxide | 50.0 g. |

As a control, a photosensitive element was prepared, exposed and processed as described above except that layer 3 of the photosensitive element was a layer of gelatin coated at a coverage of about 200 mgs/ft.$^2$ and layer 4 contained 40 mgs/ft.$^2$ each of yellow color-providing compound and gelatin with the benzidine yellow (50 mgs/ft.$^2$) being dispersed in a separate layer of gelatin (50 mgs/ft.$^2$) disposed between layers 4 and 5.

After a dark time of about 10 minutes, it was observed that the test integral negative-positive reflection print of Example 3 exhibited better color isolation than that of the control.

EXAMPLE 4

A photosensitive element, PE-4, was prepared by coating in succession on a 4 mil polyester clear film base the following layers:

| Layer | Component(s) | Coverage (mgs/ft$^2$) |
|---|---|---|
| (1) | a. cyan dye developer | 100 |
| | b. gelatin | 131 |
| (2) | a. red-sensitive gelatino silver iodobromide emulsion | 140 |
| | b. gelatin | 123 |
| (3) | a. BDSM* | 175 |
| | b. polyacrylamide | 5 |
| (4) | a. magenta dye developer | 112 |
| | b. gelatin | 99 |
| (5) | a. green-sensitive gelatino silver iodobromide emulsion | 100 |
| | b. gelatin | 88 |
| (6) | a. BDSM* | 94 |
| | b. polyacrylamide | 12 |
| | c. succinaldehyde | 11 |
| (7) | a. yellow dye developer | 70 |
| | b. gelatin | 49 |
| (8) | a. blue-sensitive gelatino silver iodobromide emulsion | 120 |
| | b. gelatin | 119 |
| | c. 4' methylphenylhydroquinone | 30 |
| (9) | a. gelatin | 40 |

*where BDSM has the same meaning as in Example 1 and the same dye developers as used in Example 1 were used.

Samples A, B, and C were prepared by coating over the element.

For A. 50/mg/sq. ft. gelatin

For B. 50 mg/sq. ft. of the sodium salt of poly[1-(p-vinylphenyl)-1,2,3,4-tetrazole-5-thiol]

For C. 100 mg/sq. ft. of the sodium salt of poly[1-(p-vinylphenyl)-1,2,3,4-tetrazole-5-thiol].

An image-receiving component was prepared by coating on a transparent 4 mil polyethylene terephthalate film base in succession of the following layers:

1. as a polymeric acid layer, the partial butyl ester of polyethylene/maleic anhydride copolymer at a coverage of about 2500 mgs./ft.$^2$;

2. a timing layer containing about a 93:7 ratio of a 60-30-4-6 copolymer of butylacrylate, diacetone acrylamide, styrene and methacrylic acid and polyvinyl alcohol at a coverage about 500 mgs./ft.$^2$;

3. a polymeric image-receiving layer containing a 2:1 mixture, by weight, of polyvinyl alcohol and poly-4-vinylpyridine, at a coverage of about 300 mgs./ft.$^2$.

The photosensitive elements were then exposed and processed in the dark by spreading an aqueous liquid processing composition comprising:

| | | |
|---|---|---|
| Potassium hydroxide (45%) | 19.78 | g. |
| Cesium hydroxide (50%) | 10.64 | g. |
| Benzotriazole | 1.18 | g. |
| 5-hydroxyazabenzimidazole | 0.118 | g. |
| 6-Bromo-5-methyl-4-azabenzimidazole | 0.059 | g. |
| 2-methylimidazole | 0.414 | g. |
| Sodium carboxymethyl cellulose | 4.43 | g. |
| Titanium dioxide | 59.27 | g. |
| Phenylethylpicolinium bromide | 4.19 | g. |
| Water | 100 | ml |

between the image receiving element and the exposed photosensitive element of each sample as they were brought into superposed relationship. Immediately the superposed elements were placed in a light tight box wherein they remained for ten minutes. The photosensitive elements and the receiving sheets were then separated. The receiving sheets of each sample were analyzed by x-ray fluorescence for the amount of silver transferred. In the control sample, (overcoat of 50 mg/ft$^2$ of gelatin), 63 mg/sq ft. of silver was transferred. With the overcoat of 50 mg/ft. of the sodium salt of poly[1-(p-vinylphenyl)-1,2,3,4-tetrazole-5-thiol] there were 39.7 mg/sq. ft. of silver transferred, a reduction of 37%; with the 100 mg/sq. ft. overcoat of the same salt, there was 25.2 mg of silver transferred, a 60% reduction. Similar results were obtained where the mercaptide polymer was the potassium salt of poly[1-(p-vinylbenzyl)-1,2,3,4-tetrazole-5-thiol].

Throughout the specification and claims, the expression "superposed" has been used. This expression is intended to cover the arrangement of two layers in overlying relation to each other either in face-to-face contact or in separated condition and including between them at least a layer of fluid processing composition.

It also will be recognized that, where desired, the film unit structure may also comprise an integral positive/-negative construction carried on a single support.

In addition to the described layers, it will be recognized that the film unit may also contain one or more subcoats or layers, which, in turn, may contain one or more additives such as plasticizers, intermediate layers for the purpose, for example, of improving adhesion, and that any one or more of the described layers may comprise a composite of two or more of the same, or different, components, and which may be contiguous, or separated from each other as, for example, two or more neutralizing layers, or the like, one of which may be dispersed intermediate the cyan dye image-forming component retaining layer and the dimensionally stable base.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. A photosensitive element comprising a support upon which is coated at least a photosensitive silver halide emulsion layer and a nonphotosensitive layer including a compound

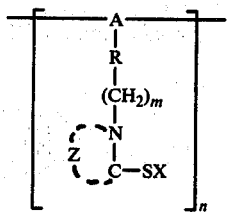

wherein A is an ethylenically unsaturated group which has been polymerized, R is phenylene, and A taken with R is selected from the group consisting of vinylphenyl, acrylamidophenyl, (2-acrylamido-2-methyl)propionamidophenyl, and p-formylphenyl acetal, X is alkali metal or primary, secondary, tertiary or quaternary ammonium, Z represents the atoms and bonds necessary to complete a 1,2,3,4-tetrazole ring, m is 0 or 1 when A taken with R is vinylphenyl and m is 0 when A taken with R is acrylamidophenyl, (2-acrylamido-2-methyl)-propionamidophenyl or p-formylphenyl acetal and n is an integer of at least 100.

2. The photosensitive element of claim 1 wherein said nonphotosensitive layer including said compound is next adjacent said photosensitive silver halide layer.

3. The photosensitive element of claim 1 wherein A taken with R is vinylphenyl and m is 0.

4. The photosensitive element of claim 3 wherein X is alkali metal, ammonium or quaternary ammonium.

5. The photosensitive element of claim 4 wherein X is sodium.

6. The photosensitive element of claim 4 wherein X is potassium.

7. A photosensitive element comprising a support upon which is coated at least a photosensitive silver halide emulsion layer and a nonphotosensitive layer including a compound

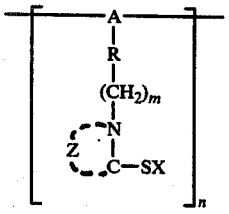

wherein X is alkali metal, ammonium or quaternary ammonium, A is polymerized vinyl, R is phenylene Z represents the atoms and bonds necessary to complete a 1,2,3,4-tetrazole ring, m is 1 and n is an integer of at least 100.

8. The photosensitive element of claim 7 wherein X is potassium.

9. The photosensitive element of claim 1 wherein A taken with R is acrylamidophenyl and m is 0.

10. The photosensitive element of claim 9 wherein X is alkali metal, ammonium or quaternary ammonium.

11. A photosensitive element which comprises:

(a) a support layer;

(b) at least two selectively sensitized silver halide emulsion layers each having associated therewith a dye image-forming material; and (c) a layer intermediate said emulsion layers comprising a compound

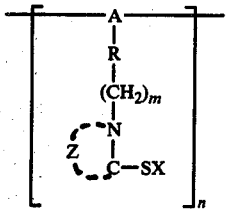

wherein A is an ethylenically unsaturated group which has been polymerized, R is phenylene, and A taken with R is selected from the group consisting of vinylphenyl, acrylamidophenyl, (2-acrylamido-2-methyl)propionamidophenyl, and p-formylphenyl acetal, X is alkali metal or primary, secondary, tertiary or quaternary ammonium, Z represents the atoms and bonds necessary to complete a 1,2,3,4-tetrazole ring, m is 0 or 1 when A taken with R is vinylphenyl, and m is 0 when A taken with R is acrylamidophenyl, (2-acrylamido-2-methyl)-propinamidophenyl or p-formylphenyl acetal, and n is an integer of at least 100.

12. The photosensitive element of claim 11 wherein said dye image-forming material is a dye which is a silver halide developing agent.

13. The photosensitive element of claim 11 wherein A taken with R is vinylphenyl and m is 0.

14. The photosensitive element of claim 11 wherein X is alkali metal, ammonium, or quaternary ammonium.

15. The photosensitive element of claim 14 wherein X is sodium.

16. The photosensitive element of claim 14 wherein X is potassium.

17. The photosensitive element of claim 11 wherein A taken with R is acrylamidophenyl and m is 0.

18. The photosensitive element of claim 17 wherein X is alkali metal, ammonium or quaternary ammonium.

19. As a product, a photographic film unit which comprises, in combination, a diffusion transfer photosensitive element and a diffusion transfer image receiving layers, said photosensitive element containing a plurality of layers including, in sequence:

(a) a support layer;

(b) a cyan die image-forming material containing layer;

(c) a red-sensitive gelatino-silver halide emulsion layer;

(d) an interlayer;

(e) a magenta dye image-forming material containing layer;

(f) a green-sensitive gelatino-silver halide emulsion layer;

(g) an interlayer;

(h) a yellow dye image-forming material containing layer; and (i) a blue-sensitive gelatino-silver halide emulsion layer;

wherein at least one of said interlayers comprises a compound

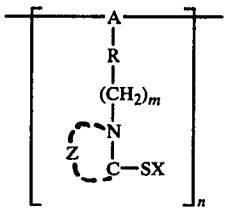

wherein A is an ethylenically unsaturated group which has been polymerized, R is phenylene, and A taken with R is selected from the group consisting of vinylphenyl, acrylamidophenyl, (2-acrylamido-2-methyl)propionamidophenyl, and p-formylphenyl acetal, X is alkali metal or primary, secondary, tertiary or quaternary ammonium, Z represents the atoms and bonds necessary to complete a 1,2,3,4-tetrazole ring, m is 0 or 1 when A taken with R is vinylphenyl, and m is 0 when A taken with R is acrylamidophenyl, (2-acrylamido-2-methyl)propionamidophenyl or p-formylphenyl acetal, and n is an integer of at least 100.

20. The photographic film unit of claim 19 wherein each of said cyan, magenta and yellow dye image-forming materials is a silver halide developing agent.

21. The photographic film unit of claim 19 wherein X is alkali metal, ammonium or quaternary ammonium.

22. A photosensitive element which comprises a plurality of layers including, in sequence:

(a) a support layer;
(b) a cyan dye image-forming material containing layer;
(c) a red-sensitive gelatino-silver halide emulsion layer;
(d) an interlayer;
(e) a magenta dye image-forming material containing layer;
(f) a green-sensitive gelatino-silver halide emulsion layer;
(g) an interlayer;
(h) a yellow dye image-forming material containing layer;
(i) a blue-sensitive gelatino-silver halide emulsion layer; and
(j) a silver ion migration control layer; wherein said silver ion migration control layer comprises a compound

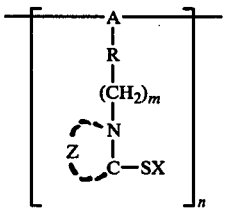

wherein A is an ethylenically unsaturated group which has been polymerized, R is phenylene, and A taken with R is selected from the group consisting of vinylphenyl, acrylamidophenyl, (2-acrylamido-2-methyl)propionamidophenyl, and p-formylphenyl acetal, X is alkali metal or primary, secondary, tertiary or quaternary ammonium, Z represents the atoms and bonds necessary to complete a 1,2,3,4-tetrazole ring, m is 0 or 1 when A taken with R is vinylphenyl and m is 0 when A taken with R is acrylamidophenyl, (2-acrylamido-2-methyl)propionamidophenyl or p-formylphenyl acetal, and n is an integer of at least 100.

23. The photosensitive element of claim 22 wherein A taken with R is vinylphenyl and m is 0.

24. The photosensitive element of claim 23 wherein X is alkali metal, ammonium or quaternary ammonium.

25. The photosensitive element of claim 24 wherein X is sodium.

26. The photosensitive element of claim 24 wherein X is potassium.

27. A photosensitive element which comprises a plurality of layers including, in sequence:

(a) a support layer;
(b) a cyan die image-forming material containing layer;
(c) a red-sensitive gelatino-silver halide emulsion layer;
(d) an interlayer;
(e) a magenta dye image-forming material containing layer;
(f) a green-sensitive gelatino-silver halide emulsion layer;
(g) an interlayer;
(h) a yellow dye image-forming material containing layer;
(i) a blue-sensitive gelatino-silver halide emulsion layer; and
(j) a silver ion migration control layer; wherein said silver ion migration control layer comprises a compound

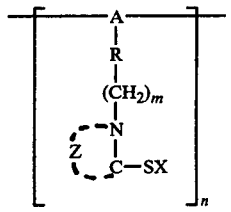

wherein A is alkali metal, ammonium or quaternary ammonium, A is polymerized vinyl, R is phenylene, Z represents the atoms and bonds necessary to complete 1,2,3,4-tetrazole ring, m is 1 and n is an integer of at least 100.

28. The photosensitive element of claim 27 wherein X is potassium.

29. The photosensitive element of claim 22 wherein A taken with R is acrylamidophenyl and m is 0.

30. The photosensitive element of claim 29 wherein X is alkali metal, ammonium or quaternary ammonium.

31. A photographic film unit which comprises, in combination, a diffusion transfer photosensitive element and a diffusion transfer image-receiving layer, said photosensitive element containing a plurality of layers including in sequence:

(a) a support layer;
(b) a cyan dye image-forming material containing layer;
(c) a red-sensitive gelatino-silver halide emulsion layer;
(d) an interlayer;
(e) a magenta-dye image-forming material containing layer;

(f) a green-sensitive gelatino-silver halide emulsion layer;
(g) an interlayer;
(h) a yellow dye image-forming material containing layer;
(i) a blue-sensitive gelatino-silver halide emulsion layer; and
(j) a silver ion migration control layer; wherein said silver ion migration control layer comprises a compound

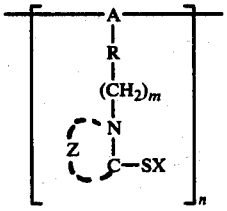

wherein A is an ethylenically unsaturated group which has been polymerized, R is phenylene, and A taken with R is selected from the group consisting of vinylphenyl, acrylamidophenyl, (2-acrylamido-2-methyl)propionamidophenyl, and p-formylphenyl acetal, X is alkali metal or primary, secondary, tertiary or quaternary ammonium, Z represents the atoms and bonds necessary to complete a 1,2,3,4-tetrazole ring, m is 0 or 1 when taken with R is vinylphenyl, and m is 0 when taken with R is acrylamidophenyl, (2-acrylamido-2-methyl)-propionamidophenyl or p-formylphenyl acetal, and n is an integer of at least 100.

32. The photographic film unit of claim 31 wherein each of said cyan, magenta and yellow dye image-forming material is a silver halide developing agent.

33. The photographic film unit of claim 31 wherein X is alkali metal, ammonium or quaternary ammonium.

34. A diffusion transfer photosensitive element which comprises,
(a) a support layer;
(b) at least two selectively sensitized silver halide emulsion layers, and
(c) at least two dye-containg layers comprising dye image-forming material each associated with one of said silver halide emulsion layers; wherein at least one of said dye containing layers further comprises as a dye dispersant a compound

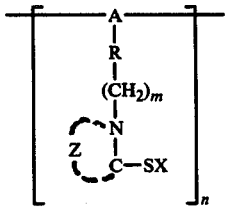

wherein A is an ethylenically unsaturated group which has been polymerized, R is phenylene, and A taken with R is selected from the group consisting of vinylphenyl, acrylamidophenyl, (2-acrylamido-2-methyl)propionamidophenyl, and p-formylphenyl acetal, X is alkali metal or primary, secondary, tertiary or quaternary ammonium, Z represents the atoms and bonds necessary to complete a 1,2,3,4-tetrazole ring, m is 0 or 1 when A taken with R is vinylphenyl, and m is 0 when A taken with R is acrylamidophenyl, (2-acrylamido-2-methyl)propionamidophenyl or p-formylphenyl acetal and n is an integer of at least 100.

35. The photosensitive element of claim 34 wherein A taken with R is vinylphenyl and m is 0.

36. The photosensitive element of claim 35 wherein X is alkali metal, ammonium or quaternary ammonium.

37. The photosensitive element of claim 36 wherein X is sodium.

38. The photosensitive element of claim 36 wherein X is potassium.

39. A diffusion transfer photosensitive element which comprises,
(a) a support layer;
(b) at least two selectively sensitized silver halide emulsion layers; and
(c) at least two dye-containing layers comprising dye image-forming material each associated with one of said silver halide emulsion layers; wherein at least one of said dye containing layers further comprises as a dye dispersant a compound

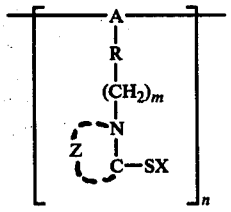

wherein X is alkali metal, ammonium or quaternary ammonium A is polymerized vinyl, R is phenylene Z represents the atoms and bonds necessary to complete a 1,2,3,4-tetrazole ring, m is 1 and n is an integer of at least 100.

40. The photosensitive element of claim 39 wherein X is potassium.

41. The photosensitive element of claim 34 wherein A taken with R is acrylamidophenyl and m is 0.

42. The photosensitive element of claim 41 wherein X is alkali metal, ammonium or quaternary ammonium.

43. A photographic film unit which comprises, in combination, a diffusion transfer photosensitive element and a diffusion transfer image-receiving element, said photosensitive element containing a plurality of layers including, in sequence:
(a) a support layer;
(b) a cyan dye image-forming material containing layer;
(c) a red-sensitive gelatino-silver halide emulsion layer;
(d) an interlayer;
(e) a magenta dye image-forming material containing layer;
(f) a green-sensitive gelatino-silver halide emulsion layer;
(g) an interlayer;
(h) a yellow dye image-forming material containing layer; and
(i) a blue-sensitive gelatino-silver halide emulsion layer; wherein at least one of said dye-containing layers comprises as a dye dispersant a compound

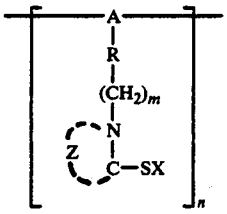

wherein A is an ethylenically unsaturated group which has been polymerized, R is phenylene, and A taken with R is selected from the group consisting of vinylphenyl, carylamidophenyl, (2-acrylamido-2-methyl)propionamidophenyl, and p-formylphenyl acetal, X is alkali metal or primary, secondary, tertiary or quaternary ammonium, Z represents tha toms and bonds necessary to complete a 1,2,3,4-tetrazole ring, m is 0 or 1 when A tken with R is vinylphenyl, and m is 0 when A taken with R is acrylamidophenyl, (2-acrylamido-2-methyl)propionamidophenyl or p-formylphenyl acetal, and n is an integer of at least 100.

44. The photographic film unit of claim 43 wherein each of said cyan, magenta and yellow dye image-forming materials is a silver halide developing agent.

45. The photographic film unit of claim 43 wherein X is alkali metal, ammonium, or quaternary ammonium.

46. The photographic film unit of claim 45 wherein X is potassium.

47. A photographic film unit as defined in claim 43 including a rupturable container containing an aqueous alkaline solution affixed to one edge of one of said combination of said photosensitive element and said image-receiving layer, and adapted to rupture and distribute its contents intermediate said photosensitive element and said image-receiving layer as or after said element and layer are superposed.

* * * * *